US007401595B2

(12) United States Patent
Kimura et al.

(10) Patent No.: US 7,401,595 B2
(45) Date of Patent: Jul. 22, 2008

(54) FUEL INJECTION DEVICE FOR INTERNAL COMBUSTION ENGINE

(75) Inventors: Kenji Kimura, Numazu (JP); Hiroyasu Sato, Numazu (JP)

(73) Assignee: Kokusan Denki Co., Ltd., Numazu-shi (JP)

( * ) Notice: Subject to any disclaimer, the term of this patent is extended or adjusted under 35 U.S.C. 154(b) by 43 days.

(21) Appl. No.: 11/641,309

(22) Filed: Dec. 19, 2006

(65) Prior Publication Data

US 2007/0137621 A1 Jun. 21, 2007

(30) Foreign Application Priority Data

Dec. 19, 2005 (JP) ..... 2005-365231

(51) Int. Cl.
*F02M 51/00* (2006.01)

(52) U.S. Cl. ..... 123/490; 123/478; 361/152

(58) Field of Classification Search ..... 123/478, 123/490, 472, 480; 701/103, 104, 105; 361/152, 361/154

See application file for complete search history.

(56) References Cited

U.S. PATENT DOCUMENTS 4,377,144 A * 3/1983 Takahashi ..... 123/490
5,216,994 A * 6/1993 Aoki et al. ..... 123/490
5,415,136 A * 5/1995 Doherty et al. ..... 123/46 SC
5,992,391 A * 11/1999 Yamakado et al. ..... 123/490
6,148,800 A * 11/2000 Cari et al. ..... 123/490
6,684,862 B2 * 2/2004 Oyama et al. ..... 123/490
6,712,048 B2 * 3/2004 Aoki et al. ..... 123/490
6,766,789 B2 * 7/2004 Yamakado et al. ..... 123/490
6,832,601 B2 * 12/2004 Watanabe et al. ..... 123/490
6,836,721 B2 * 12/2004 Stevens ..... 701/104
7,287,966 B2 * 10/2007 French et al. ..... 417/416
2002/0189593 A1 * 12/2002 Yamakado et al. ..... 123/490
2007/0044769 A1 * 3/2007 Kim ..... 123/479

FOREIGN PATENT DOCUMENTS

JP 09-209893 8/1997
JP 2002-021624 1/2002

* cited by examiner

*Primary Examiner*—Willis R. Wolfe, Jr.
*Assistant Examiner*—Johnny H. Hoang
(74) *Attorney, Agent, or Firm*—Pearne & Gordon LLP

(57) ABSTRACT

A fuel injection device for an internal combustion engine including: an injector that injects fuel to be supplied to the internal combustion engine; a battery to which a DC converter that charges a capacitor of a capacitor discharge ignition circuit is connected as a load; a control portion that is provided to operate when a power supply voltage is provided from the battery through a power supply circuit, and generates an injection command signal when fuel injection timing is detected; and an injector drive circuit that applies a driving voltage from the battery to the injector while receiving the injection command signal, wherein the device further comprises converter operation stopping portion for stopping an operation of the DC converter during set load driving stop time when the injection command signal is generated.

8 Claims, 3 Drawing Sheets

Prior Art
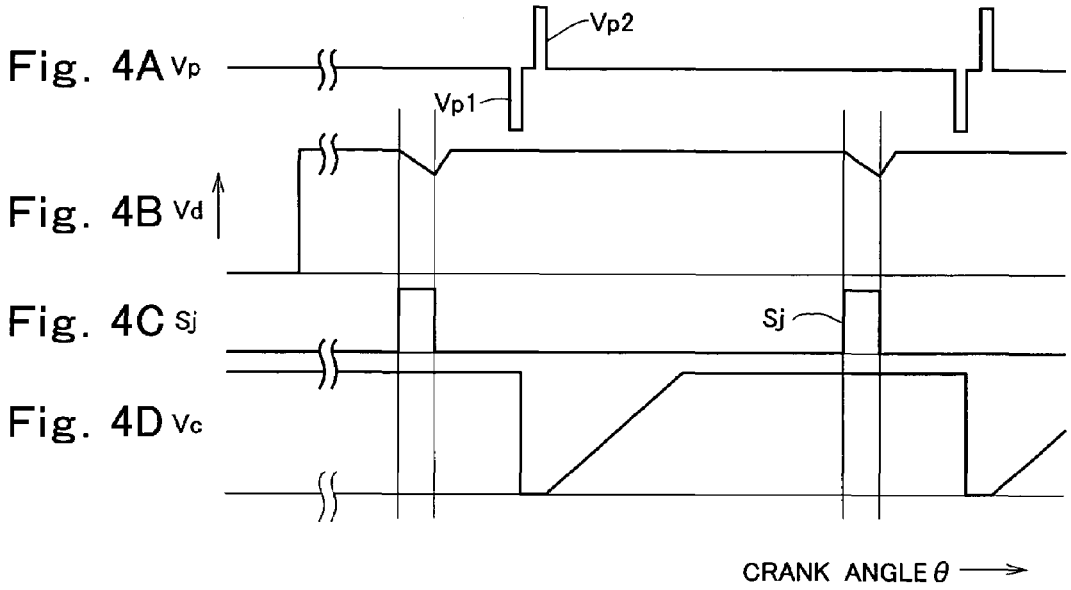
Prior Art
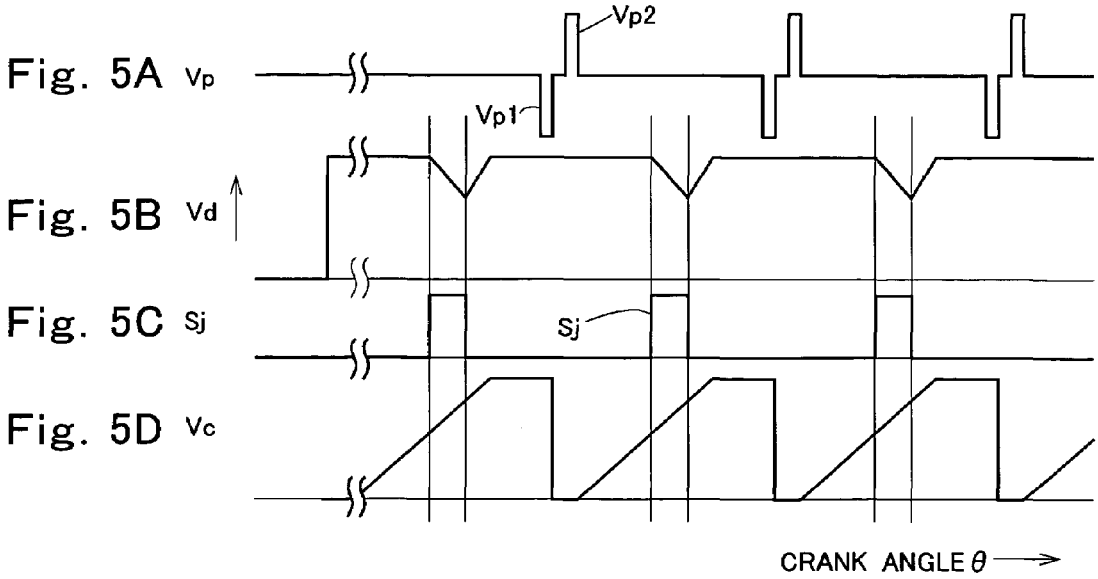

FUEL INJECTION DEVICE FOR INTERNAL COMBUSTION ENGINE

TECHNICAL FIELD OF THE INVENTION

The present invention relates to a fuel injection device that supplies fuel to an internal combustion engine.

BACKGROUND OF THE INVENTION

A fuel injection device has been used as a device for supplying fuel to an internal combustion engine. The fuel injection device includes an injector having a valve driven by a solenoid, a fuel pump that supplies fuel to the injector, and a regulator that controls pressure of the fuel supplied from the fuel pump to the injector to be kept constant. When such a fuel injection device is used to supply the fuel to the internal combustion engine, the device includes an injector drive circuit that applies a driving voltage from a battery to the solenoid of the injector and passes a driving current through the solenoid while receiving an injection command signal, and a control portion that receives a power supply voltage from the battery through a power supply circuit and is mainly constituted by a microprocessor, and the control portion provides the injection command signal to the injector drive circuit when fuel injection timing (timing for starting injection of the fuel) is detected. The injector opens a valve when receiving the injection command signal, and injects the fuel into an intake pipe or a cylinder of the internal combustion engine. Such a fuel injection device is disclosed in, for example, Japanese Patent Laid-Open No. 2002-21624.

An amount of fuel supplied from the injector to the engine (a fuel injection amount) is determined by pressure of the fuel supplied to the injector, and time for the injector opening the valve (fuel injection time). The pressure of the fuel supplied to the injector is kept substantially constant, and generally, the fuel injection amount is controlled by the fuel injection time. The injector does not start injection of the fuel immediately after the driving voltage is applied, but opens the valve and starts the injection of the fuel at a predetermined delay time after the driving voltage is supplied. Time between when the injector receives the driving voltage and when the injector starts the injection of the fuel is referred to as an ineffective injection time. The control portion regards actual injection time plus the ineffective injection time as apparent injection time, and supplies an injection command signal having a signal width equal to the apparent injection time is provided to the injector drive circuit. As disclosed in Japanese Patent Laid-Open No. 2002-21624, the ineffective injection time of the injector varies depending on the driving voltages supplied to the injector. Generally, the ineffective injection time is reduced with increase in the driving voltage supplied to the injector. If the driving voltage is reduced in the opening process of the valve of the injector to increase the ineffective injection time, the actual injection time is reduced to cause a shortage of fuel injection amount. Thus, in order to precisely inject a predetermined amount of fuel, it is necessary to prevent a reduction in the driving voltage in driving the injector.

Generally, an electrical component other than the injector drive circuit and the control portion as a further load is connected to a battery. When the internal combustion engine is a gasoline engine and uses an ignition device using a battery as power supply, the further component includes an ignition device for an internal combustion engine.

A known ignition device for an internal combustion engine using a battery as power supply is a capacitor discharge ignition device including a DC converter that increases a voltage of the battery, and a capacitor discharge ignition circuit that uses the DC converter as a capacitor charging power supply. As disclosed in Japanese Patent Laid-Open No. 9-209893, the capacitor discharge ignition circuit is comprised of an ignition coil, a capacitor provided on a primary side of the ignition coil and charged to one polarity by an output of the DC converter, and a discharge switch that turns on when receiving an ignition signal and discharges charges accumulated in the capacitor through a primary coil of the ignition coil.

When such an ignition device is used, means for controlling ignition timing is further provided in the control portion. In this case, the control portion arithmetically operates ignition timing of the internal combustion engine for various control conditions, and provides an ignition signal to the discharge switch when the arithmetically operated ignition timing is detected. When the ignition signal is provided to the discharge switch, the discharge switch turns on and thus discharges the charges in the capacitor through the ignition coil, and the discharge induces a high voltage for ignition in a secondary coil of the ignition coil. The high voltage is applied to an ignition plug mounted to a cylinder of the engine, and thus spark discharge occurs in the ignition plug to ignite the engine.

As an ignition device using a battery as power supply, a current interruption ignition device is also known that interrupts a current having passed from a battery through a primary coil of an ignition coil when ignition timing is detected to induce a high voltage for ignition in a secondary coil of an ignition coil, but detailed descriptions thereof will be omitted. As the electrical component other than the injector drive circuit and the control portion, an electric actuator for operating a throttle valve of the engine or an exhaust valve may be provided.

As described above, in the case where the further electrical component as the load is connected to the battery to which the injector drive circuit and the control portion as the loads are connected, the driving voltage of the battery may be significantly reduced if the ignition command signal is generated with electric power being consumed by the further load and the driving current passes from the battery through the solenoid of the injector. If the driving voltage applied from the battery to the injector is significantly reduced, the ineffective injection time may be increased to cause a shortage of actual injection time and a shortage of fuel injection amount.

Thus, in the control device disclosed in Japanese Patent Laid-Open No. 2002-21624, the fuel injection device and the further load are not simultaneously driven. In the control device, the current interruption ignition device is used as the ignition device for igniting the engine, and driving of at least one of the injector and the fuel pump is stopped while the primary current passes through the ignition coil of the ignition device.

The construction as disclosed in Japanese Patent Laid-Open No. 2002-21624 can prevent a reduction in the battery voltage and an increase in the ineffective injection time in the process of opening the valve of the injector. However, if the injector is not driven while the current passes from the battery through the ignition device, and a period in which a large current passes from the battery through the ignition device matches a period in which the injector is driven, fuel injection to be performed is not performed, thereby causing another problem of a shortage of amount of fuel supplied to the engine. There is no problem if the period in which the large current passes from the battery through the ignition device does not match the period in which the injector is driven, but it is difficult that the period in which the current passes through the ignition device does not match the period in which the injector is driven both during low speed rotation and high speed rotation.

In the invention disclosed in Japanese Patent Laid-Open No. 2002-21624, if the driving of the fuel pump is stopped when the current passes from the battery through the ignition device, the injector can be driven. In this case, however, the injector is driven with the current passing from the battery through the ignition device, and thus the problem cannot be solved that the battery voltage is reduced in the process of opening the valve of the injector to cause the shortage of fuel injection amount.

SUMMARY OF THE INVENTION

An object of the present invention is to provide a fuel injection device for an internal combustion engine that performs a fuel injection operation with a large current passing through a load other than an injector, and prevents a reduction in a battery voltage and an increase in ineffective injection time in the process of opening a valve of the injector, thereby preventing a shortage of fuel injection amount.

The present invention is applied to a fuel injection device for an internal combustion engine including: an injector that injects fuel to be supplied to the internal combustion engine; an injector drive circuit that uses a battery to which various loads are connected as power supply and applies a driving voltage to the injector while receiving an injection command signal; and a control portion that is provided to operate when a power supply voltage is provided from the battery through a power supply circuit, and provides the injection command signal to the injector drive circuit when fuel injection timing of the internal combustion engine is detected.

In the present invention, the fuel injection device further includes load driving stopping means for stopping supply of electric power to a load other than the injector drive circuit and the control portion and through which a load current equal to or higher than a set value passes in operation among the loads connected to the battery, during load driving stop time set to be equal to or shorter than a signal width of the injection command signal, when the injection command signal is generated.

As described above, the load driving stopping means is provided for stopping the supply of the electric power to the load other than the injector drive circuit and the control portion and through which the load current equal to or higher than the set value passes among the loads connected to the battery, during the set load driving stop time, when the injection command signal is generated. This can prevent a significant reduction in battery voltage when the injection command signal is generated and a driving current passes through the injector, thereby preventing an increase in ineffective injection time in the process of opening a valve and preventing a shortage of fuel injection amount.

In the present invention, a fuel injection operation is always prioritized, and is not sacrificed in driving the further load, thereby preventing a shortage of fuel injection amount both during low speed rotation and high speed rotation of the engine.

The above described "further load through which the load current equal to or higher than the set value passes in operation" means a further load (a load other than the injector drive circuit and the control portion) that may reduce the battery voltage to the extent that considerable variation occurs in the ineffective injection time of the injector when driven simultaneously with the injector.

In order to minimize influence on the operation of the load other than the injector drive circuit and the control portion, the load driving stopping means is preferably comprised so as to stop the supply of the electric power to the further load only during the load driving stop time set to be shorter than the signal width of the injection command signal when the injection command signal is generated.

In this case, too short load driving stop time may cause energization to the further load to restart before the valve of the injector opens, and cause considerable variation in the ineffective injection time of the injector. Also, too long load driving stop time may have unpreferable influence on the operation of the further load. Thus, the load driving stop time is set to a value suitable for keeping the reduction in the battery voltage that occurs in driving of the injector within a permissible range (a range required for keeping the variation in the ineffective injection time of the injector within a permissible range).

When there is no harm in stopping the driving of the further load while the injection command signal is generated, the load driving stopping means may be comprised so as to stop, with the load driving stop time made equal to the signal width of the injection command signal, the supply of the electric power to the load other than the injector drive circuit and the control portion while the injection command signal is generated. When the load driving stopping means is thus comprised, the load driving stop time can be easily determined, thereby simplifying a construction of the load driving stopping means.

The ineffective injection time of the injector varies depending on the level of voltage applied to the injector, and thus the load driving stop time may be set according to a battery voltage detected immediately before the injection command signal is generated.

Further, if the reduction in the battery voltage when the injector and the further load are simultaneously driven becomes a problem only in an area with a relatively low rotational speed of the engine where an output of a generator for charging the battery tends to be insufficient, the load driving stopping means may be comprised so as to detect the rotational speed of the engine, and stop the supply of the electric power to the further load during the set load driving stop time only when the detected rotational speed is equal to or lower than the set value.

In a preferable aspect of the present invention, a DC converter that outputs a voltage used for charging a capacitor of a capacitor discharge ignition device for an internal combustion engine is connected to a battery as a load, and a fuel injection device includes an injector drive circuit that uses the battery as power supply and applies a driving voltage to an injector while receiving an injection command signal, and a control portion that is provided to operate when a power supply voltage is provided from the battery through a power supply circuit, and provides an injection command signal to the injector drive circuit at fuel injection timing of the internal combustion engine. When the present invention is applied to such a fuel injection device, converter operation stopping means is provided for stopping an operation of the DC converter during load driving stop time set to be equal to or shorter than a signal width of the injection command signal.

In this case, the converter operation stopping means may be comprised so as to stop the operation of the DC converter during the set load driving stop time only when the rotational speed of the internal combustion engine is equal to or lower than the set value.

Also in this case, the load driving stop time may be set according to the battery voltage detected immediately before the injection command signal is generated.

In the capacitor discharge ignition device in which the capacitor is charged by the DC converter, the capacitor may be charged during one rotation of the engine, and thus there is no harm in the ignition operation even if the operation of the DC converter is stopped only during a short time for fuel injection in the process of the charging. Thus, as described above, the operation of the DC converter is stopped while the injection command signal is generated, thereby preventing the reduction in the battery voltage and preventing a shortage of fuel injection amount without sacrificing the ignition operation.

As described above, according to the present invention, the load driving stopping means is provided for stopping the supply of the electric power to the load other than the injector drive circuit and the control portion and through which the load current equal to or higher than the set value passes among the loads connected to the battery, during the set load driving stop time, when the fuel injection command signal is generated. This can prevent the reduction in the battery voltage and the increase in the ineffective injection time in the process of opening the valve of the injector, thereby preventing a shortage of fuel injection amount.

BRIEF DESCRIPTION OF THE DRAWINGS

The above and other objects and features of the invention will be apparent from the detailed description of the preferred embodiments of the invention, which is described and illustrated with reference to the accompanying drawings, in which;

FIGS. 3A to 3E are waveform charts schematically showing signal waveforms and voltage waveforms of portions of the device in FIG. 1;

FIGS. 4A to 4D are waveform charts schematically showing signal waveforms and voltage waveforms observed at portions of a conventional fuel injection device when a rotational speed of an engine is low; and FIGS. 5A to 5D are waveform charts schematically showing signal waveforms and voltage waveforms observed at portions of a conventional fuel injection device when a rotational speed of an engine is high.

DETAILED DESCRIPTION OF THE PREFERRED EMBODIMENTS

Now, a preferred embodiment of the present invention will be described in detail with reference to the drawings.

Figure 1:
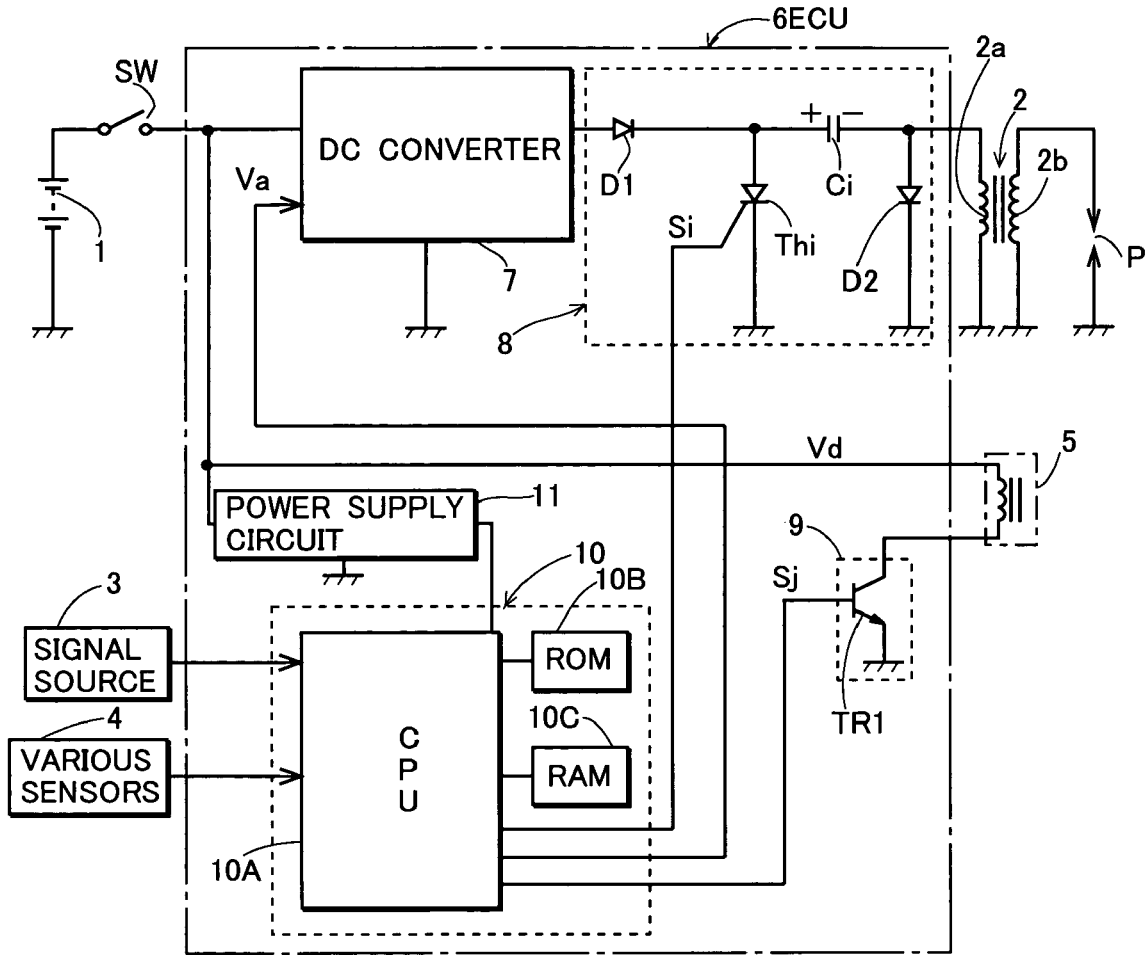
FIG. 1 is a schematic circuit diagram of an exemplary configuration of hardware of a fuel injection device according to the present invention.

FIG. 1 shows an exemplary configuration of hardware of a fuel injection device according to the present invention. In FIG. 1, a reference numeral 1 denotes a battery having a grounded negative terminal; 2, an ignition coil; 3, a signal source that generates a pulse signal at a predetermined crank angle position of an engine in synchronization with rotation of the engine; 4, various sensors that detect control conditions required for arithmetically operating fuel injection time; 5, an injector that is mounted to an intake pipe of the engine and injects fuel into the intake pipe downstream of a throttle valve; and 6, an electronic control unit (ECU) that controls an ignition device and a fuel injection device. The sensors 4 include an intake air temperature sensor, a cooling water temperature sensor, an intake pipe internal pressure sensor, a throttle position sensor, an atmospheric pressure sensor, or the like.

The ignition coil 2 has a primary coil 2*a* and a secondary coil 2*b*, one ends of the coils are grounded, and an ungrounded terminal of the secondary coil 2*b* is connected to an ungrounded terminal of an ignition plug P mounted to a cylinder of the engine.

The signal source 3 is constituted by, for example, a pulsar mounted to the engine, and generates a pulse signal when a crank angle position of the engine matches a reference crank angle position used as a reference position in detection of fuel injection timing and ignition timing of the engine.

The injector 5 includes an injector body having an injection port at a tip thereof, a valve that is placed in the injector body and opens and closes the injection port, and a solenoid (electromagnet) that drives the valve. Fuel is supplied into the injector body from an unshown fuel pump driven by the battery 1. Pressure of the fuel supplied into the injector body is kept substantially constant by a pressure adjuster. The injector 5 opens the valve and injects fuel at a predetermined delay time (ineffective injection time) after a driving voltage is applied to the solenoid of the injector 5. The ineffective injection time of the injector is reduced with increase in the driving voltage applied to the solenoid.

The shown control unit 6 includes a DC converter 7 into which a voltage (for example, 12 V) across the battery 1 is input through a switch SW, a capacitor discharge ignition circuit 8, an injector drive circuit 9, a microprocessor 10 having a CPU 10A, a ROM 10B, a RAM 10C, or the like, and a power supply circuit 11 that converts the voltage (for example, 12 V) across the battery 1 to a certain voltage (for example, 5 V) suitable as a power supply voltage of the microprocessor 10.

The DC converter 7 include, for example, a step-up transformer to which a primary current is supplied from the battery 1, a chopper switch inserted in a passage of the primary current of the step-up transformer, and a chopper switch control portion that turns on/off the chopper switch so as to interrupt the primary current of the step-up transformer at small time intervals, and interrupts the primary current of the step-up transformer to induce a voltage increased to 200 and several ten volt in the secondary coil of the step-up transformer. The chopper switch control portion of the DC converter 7 is comprised so as to detect a voltage across a capacitor Ci of a capacitor discharge ignition circuit described later, and turn off the chopper switch when the voltage across the capacitor Ci reaches a set value required for an ignition operation to stop a voltage step-up operation. An example of the DC converter is disclosed, for example, in Japanese Patent Laid-Open No. 9-209893.

The capacitor discharge ignition circuit is basically comprised of an ignition capacitor provided on the primary side of the ignition coil and charged to one polarity by power supply, and a discharge switch that turns on when receiving an ignition signal and discharges charges in the ignition capacitor through the primary coil of the ignition coil. The shown capacitor discharge ignition circuit 8 is comprised of a diode D1 having an anode connected to an ungrounded output terminal of the DC converter 7, an ignition capacitor Ci connected between an ungrounded terminal of the primary coil 2*a* of the ignition coil and a cathode of the diode D1, a thyristor Thi connected between a connecting point of the capacitor Ci and the diode D1 and the ground, with a cathode directed to the ground, and a diode D2 connected in parallel with both ends of the primary coil 2*a* of the ignition coil, with a cathode directed to the ground. In this example, the thyristor Thi constitutes the discharge switch.

In the shown ignition circuit 8, the ignition capacitor Ci is charged to a shown polarity through the diode D1, and a parallel circuit of the diode D2 and the primary coil 2*a* by the output of the DC converter 7. When an ignition signal Si is provided from a control portion described later to a gate of the thyristor Thi, the thyristor Thi conducts and discharges the charges in the capacitor Ci through the primary coil of the ignition coil, and induces a high voltage in the primary coil 2*a*. The voltage is increased by a ratio of voltage increase between the primary and secondary coils of the ignition coil to induce an ignition high voltage in the secondary coil 2*b* of the ignition coil. The high voltage is applied to the ignition plug 11 mounted to the cylinder of the engine, thereby causing spark discharge in the ignition plug and ignition of the engine.

The shown injector drive circuit 9 is constituted by an NPN transistor TR1 having a grounded emitter and a collector connected to one end of the solenoid of the injector 5. The other end of the solenoid of the injector 5 is connected to a positive terminal of the battery 1 through the switch SW. The transistor TR1 is kept turned on while receiving an injection command signal Sj at a base thereof from the control portion described later, and applies the voltage across the battery 1 to the solenoid of the injector 5.

The microprocessor 10 executes a program stored in the ROM 10B to arithmetically operate a rotational speed of the engine from a generation cycle of pulse signals output by the signal source 3, and arithmetically operate ignition timing of the engine relative to the arithmetically operated rotational speed. The microprocessor 10 also starts a counting operation for detecting the arithmetically operated ignition timing when the signal source generates a reference pulse signal at the reference crank angle position, and provides the ignition signal Si to the thyristor Thi of the ignition circuit when the counting operation is completed (when the ignition timing is detected).

The microprocessor 10 also arithmetically operates, as basic injection time, injection time required for obtaining a predetermined air/fuel ratio relative to an intake air amount detected by an air flowmeter, an intake air amount estimated based on a throttle valve opening degree and the rotational speed, or an intake air amount estimated based on the rotational speed and the intake pipe internal pressure, corrects the basic injection time relative to various control conditions such as a temperature of the engine, atmospheric pressure, or an intake air temperature to arithmetically operate actual injection time, and adds the ineffective injection time to the actual injection time to arithmetically operate apparent injection time. Then, when detecting fuel injection start timing based on crank angle information of the engine obtained from the pulse generated by the signal source 3, the microprocessor 10 provides an injection command signal Sj having a signal width corresponding to the apparent injection time to the injector drive circuit 9.

In the embodiment, the signal source 3, the various sensors 4, and the microprocessor 10 constitute the control portion that is provided so as to operate when a power supply voltage is provided from the battery 1 through the power supply circuit 11, and provides the injection command signal Sj to the injector drive circuit 9 at fuel injection timing of the internal combustion engine. The injector 5, an unshown fuel pump that supplies fuel to the injector 5, the pressure adjuster, the injector drive circuit 9, and the control portion constitute the fuel injection device.

The constructions of the above described portions are already known. In such a fuel injection device, various loads other than the fuel injection device are generally connected to the battery 1. Particularly, as shown in the example in FIG. 1, when the ignition device using the battery as power supply is used, a relatively large amount of electric power is consumed in the ignition device. If the injection command signal is provided with a large amount of electric power consumed in the ignition device, the voltage of the battery is reduced when the driving current passes through the injector, and the driving voltage is reduced in the process of opening the valve of the injector. The reduction in the driving voltage of the injector increases the ineffective injection time, thereby reducing the actual injection time and causing a shortage of a fuel injection amount.

FIGS. 4A to 4D schematically show a waveform of a pulse signal Vp generated by the signal source 3 during low speed rotation of the engine, a waveform of a driving voltage Vd applied from the battery 1 to the solenoid of the injector 5, a waveform of the injection command signal Sj, and a waveform the voltage Vc across the capacitor Ci in a conventional fuel injection device. The pulse signal Vp shown in FIG. 4A includes a negative pulse Vp1 generated at a reference crank angle position used as a position for starting measurement of the ignition position of the engine, and a positive pulse Vp2 generated at a crank angle position delayed from the reference crank angle position, for example, near a top dead center position of the engine. In this example, when the injection command signal Sj is generated, the DC converter 7 stops a voltage step-up operation and no current passes from the battery 1 to the DC converter 7 (a load of the battery is light), thereby causing a slight reduction in the driving voltage Vd when the injection command signal is generated and a driving current passes through the injector 5. This causes little change in the ineffective injection time, and prevents a shortage of a fuel injection amount.

However, the time required for charging the capacitor Ci is substantially constant, and thus if the rotational speed of the engine is increased and time required for one rotation of a crankshaft is reduced, as shown in FIGS. 5A to 5D, the capacitor Ci is still charged and the current passes from the battery to the DC converter when the injection command signal Sj is generated. Thus, when the injection command signal Sj is generated and the driving current passes through the injector, the battery voltage is reduced to significantly reduce the driving voltage Vd of the injector. Such a state makes the ineffective injection time of the injector longer than supposed, thereby reducing the actual injection time and causing a shortage of the fuel injection amount.

In the present invention, in order to prevent occurrence of such a state, a predetermined program is executed by the microprocessor 10 to provide load driving stopping means (converter operation stopping means in the example in FIG. 1) for stopping supply of electric power to a load (the DC converter 7 in this example) other than the injector drive circuit 9 and the control portion and through which a load current equal to or higher than a set value passes in operation among the loads connected to the battery 1, during load driving stop time set to be equal to or shorter than a signal width of the injection command signal, when the injection command signal Sj is generated.

Once the valve of the injector opens, the injector keeps a valve opening state even with a slight reduction in the battery voltage, and thus after the valve of the injector opens, there is no harm in restarting driving of the load other than the injector drive circuit 9 and the control portion. Thus, the load driving stop time is preferably set to be equal to time between starting driving of the injector and opening the valve of the injector. The timing of opening the valve of the injector can be detected to some extent from changes in the voltage across the solenoid of the injector, but precise detection thereof is difficult. Thus, the load driving stopping means is preferably comprised so as to stop the supply of the electric power to the load other than the injector drive circuit and the control portion only during the load driving stop time set to be equal to or shorter than the signal width of the injection command signal when the injection command signal is generated.

In this case, too short load driving stop time may cause energization to the further load to restart before the valve of the injector opens to reduce the battery voltage, and cause considerable variation in the ineffective injection time of the injector. Also, too long load driving stop time may have unpreferable influence on the operation of the further load. Thus, the load driving stop time needs to be set to a length suitable for keeping the reduction in the battery voltage that occurs in driving of the injector within a permissible range (a range required for keeping the variation in the ineffective injection time of the injector within a permissible range) and a length within a range that has no unpreferable influence on the operation of the further load. The load driving stop time can be experimentally determined.

When there is no harm in stopping driving of the further load while the injection command signal is generated, the load driving stop time may be equal to the signal width of the injection command signal.

In the example in FIG. 1, the load driving stopping means provides a load driving stop signal Va to the DC converter 7 when the injection command signal Sj is generated. The DC converter 7 is comprised so as to keep turned off the chopper switch connected in series to the primary coil of the step-up transformer while receiving the load driving stop signal Va, and stop the voltage step-up operation.

Signal waveforms and voltage waveforms of portions when the load driving stop time is set to be equal to the signal width of the injection command signal are shown in FIG. 3. FIG. 3A shows a waveform of the pulse signal Vp generated by the signal source 3, and FIG. 3B shows a waveform of the driving voltage Vd applied from the battery 1 to the solenoid of the injector 5. FIG. 3C shows a waveform of the injection command signal Sj, FIG. 3D shows a waveform of the voltage Vc across the capacitor Ci, and FIG. 3E shows a waveform of the load driving stop signal Va.

Figure 2:
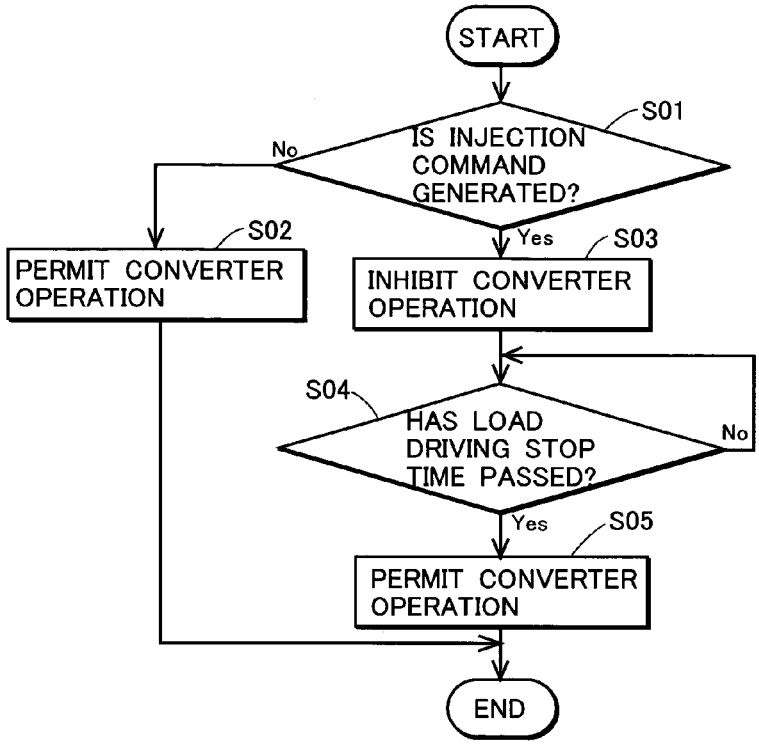
FIG. 2 is a flowchart of an example of an algorithm of processing executed by a microprocessor of a control portion for constructing converter operation stopping means in an embodiment of the present invention.
Figure 2:
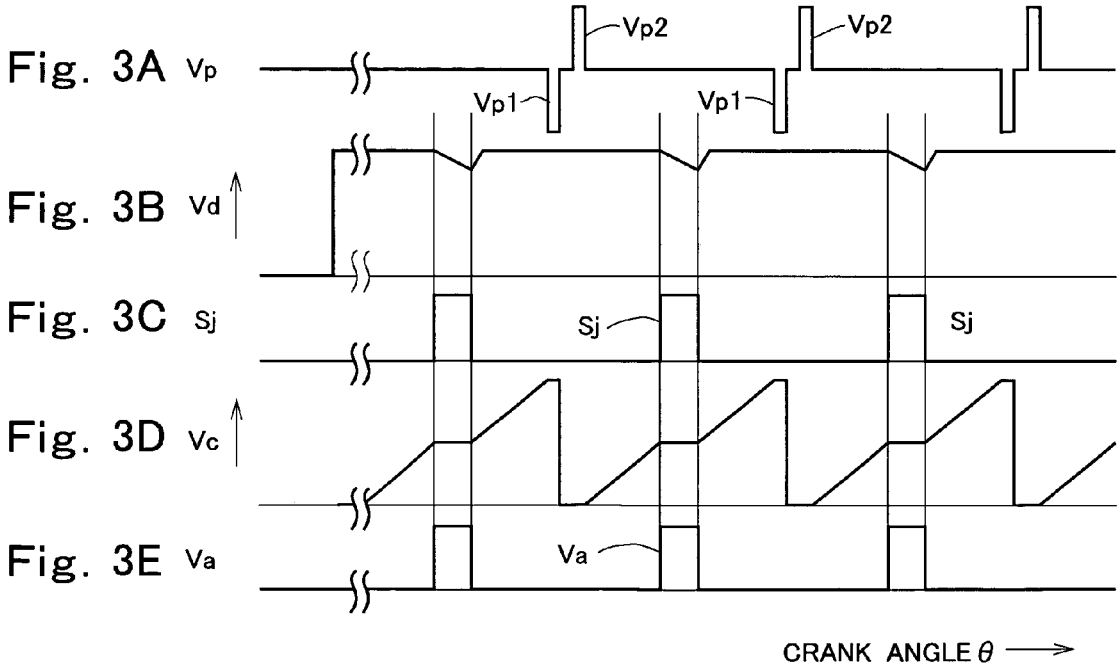

FIG. 2 is a flowchart of an algorithm of processing executed by the microprocessor for constructing the converter operation stopping means. The processing in FIG. 2 is repeatedly executed at minute time intervals, and in this processing, it is determined first in Step S01 whether the injection command signal Sj is generated. When it is determined that the injection command signal is not generated, the operation of the DC converter 7 is permitted (the load driving stop signal Va is not generated) in Step S02. When it is determined in Step S01 that the injection command signal is generated, the process proceeds to Step S03, the load driving stop signal (the converter operation stop signal) Va is generated, the signal is provided to the control portion of the DC converter to stop the supply of the electric power to the DC converter and inhibit the operation of the DC converter. Then, the passage of the load driving stop time is waited in Step S04, and when the load driving stop time has passed, the operation of the DC converter is permitted in Step S05 to restart the supply of the electric power to the DC converter.

With the above described construction, the supply of the electric power to the load (the DC converter 7 in the example in FIG. 1) other than the injector drive circuit and the control portion and through which the load current equal to or higher than the set value passes among the loads connected to the battery, when the injection command signal Sj is generated. This can prevent a reduction in the driving voltage to increase the ineffective injection time in the process of opening the valve of the injector, thereby preventing a shortage of the fuel injection amount.

In the above described example, the DC converter 7 is the load other than the injector drive circuit and the control portion, but also when a further load, for example, an actuator for operating a throttle valve is connected as the load of the battery 1, the same advantage can be obtained by stopping driving of the load while an injection command signal is generated.

In the embodiment, the converter operation stopping means is comprised so as to stop the supply of the electric power to the further load during the load driving stop time when the injection command signal is generated regardless of the rotational speed of the engine. However, when the reduction in the battery voltage becomes a problem only in an area with a relatively low rotational speed of the engine, the converter operation stopping means may be comprised so as to stop the operation of the DC converter during the load driving stop time only when the rotational speed of the internal combustion engine is equal to or lower than the set value.

In the above described embodiment, the load driving stop time is a constant value, but may be set according to a battery voltage detected immediately before the injection command signal is generated because the ineffective injection time of the injector varies depending on the voltage (battery voltage) applied to the injector. For example, the load driving stop time may be arithmetically operated by a map arithmetical operation or the like relative to the battery voltage detected immediately before the injection command signal is generated, and the supply of the electric power to the further load may be stopped during the arithmetically operated load driving stop time. The map used in arithmetically operating the load driving stop time relative to the battery voltage may be experimentally formed.

Although a preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. A fuel injection device for an internal combustion engine comprising:

an injector that injects fuel to be supplied to the internal combustion engine;

an injector drive circuit that uses a battery to which various loads are connected as power supply and applies a driving voltage to said injector while receiving an injection command signal; and a control portion that is provided to operate when a power supply voltage is provided from said battery through a power supply circuit, and provides the injection command signal to said injector drive circuit at fuel injection timing of said internal combustion engine, wherein said fuel injection device further comprises load driving stopping means for stopping supply of electric power to a load other than said injector drive circuit and said control portion and through which a load current equal to or higher than a set value passes in operation among the loads connected to said battery, during load driving stop time set to be equal to or shorter than a signal width of said injection command signal, when said injection command signal is generated.

2. The fuel injection device for an internal combustion engine according to claim 1, wherein said load driving stopping means is comprised so as to stop the supply of the electric power to said further load only when a rotational speed of said internal combustion engine is equal to or lower than a set value.

3. The fuel injection device for an internal combustion engine according to claim 1, wherein said load driving stop time is set according to a battery voltage detected immediately before said injection command signal is generated.

4. The fuel injection device for an internal combustion engine according to claim 2, wherein said load driving stop time is set according to a battery voltage detected immediately before said injection command signal is generated.

5. A fuel injection device for an internal combustion engine comprising:

an injector that injects fuel to be supplied to the internal combustion engine;

an injector drive circuit that uses, as power supply, a battery to which a DC converter that outputs a voltage used for charging a capacitor of a capacitor discharge ignition device for an internal combustion engine is connected as a load and applies a driving voltage to said injector while receiving an injection command signal; and a control portion that is provided to operate when a power supply voltage is provided from said battery through a power supply circuit, and provides the injection command signal to said injector drive circuit at fuel injection timing of said internal combustion engine, wherein said fuel injection device further comprises converter operation stopping means for stopping an operation of said DC converter during load driving stop time set to be equal to or shorter than a signal width of said injection command signal.

6. The fuel injection device for an internal combustion engine according to claim 5, wherein said converter operation stopping means is comprised so as to stop the operation of said DC converter only when a rotational speed of said internal combustion engine is equal to or lower than a set value.

7. The fuel injection device for an internal combustion engine according to claim 5, wherein said load driving stop time is set according to a battery voltage detected immediately before said injection command signal is generated.

8. The fuel injection device for an internal combustion engine according to claim 6, wherein said load driving stop time is set according to a battery voltage detected immediately before said injection command signal is generated.

* * * * *